United States Patent [19]

Vest

[11] Patent Number: 4,644,453

[45] **Date of Patent: * Feb. 17, 1987**

[54] PORTABLE FLUORESCENT LIGHT UNIT

[76] Inventor: Gary W. Vest, 4483 Broadview Rd., Cleveland, Ohio 44109

[ * ] Notice: The portion of the term of this patent subsequent to May 30, 1995 has been disclaimed.

[21] Appl. No.: 111,786

[22] Filed: Jan. 14, 1980

[51] Int. Cl.[4] ..... F21V 21/32

[52] U.S. Cl. ..... 362/223; 362/307; 362/433; 362/310; 362/374; 362/375

[58] Field of Search ..... 362/223, 368, 307, 310, 362/374, 375, 433

[56] References Cited

U.S. PATENT DOCUMENTS

| | | | |
|---|---|---|---|
| 3,242,331 | 3/1966 | Behringer et al. | 362/223 |
| 4,092,706 | 5/1978 | Vest | 362/223 X |
| 4,262,327 | 4/1981 | Kovacik et al. | 362/223 |

*Primary Examiner*—Peter A. Nelson

*Attorney, Agent, or Firm*—Pearne, Gordon, McCoy & Granger

[57] ABSTRACT

An improved portable fluorescent light unit is disclosed in which the improvement comprises a pair of electrically insulated lamp supports which facilitate assembly of the unit. Each lamp support may comprise an inner socket element and an outer supporting element. The inner socket elements fit against the ends of the lamp, and each socket element has a pair of apertures in which electrical connectors are mounted. The outer supporting element is attached to the housing of the unit and has a central opening into which the inner socket element is inserted. The lamp supports may also include means for accommodating thermal expansion of the housing by having the inner socket element being slidably mounted with the opening and movable in a direction parallel to the axis of the fluorescent lamp. The electrical connectors may have cylindrical portions adapted to fit circumferentially around the pins extending from the fluorescent lamp and to extend axially a substantial distance along the length of the pin to avoid the problems of point contact mounting arrangements.

29 Claims, 5 Drawing Figures

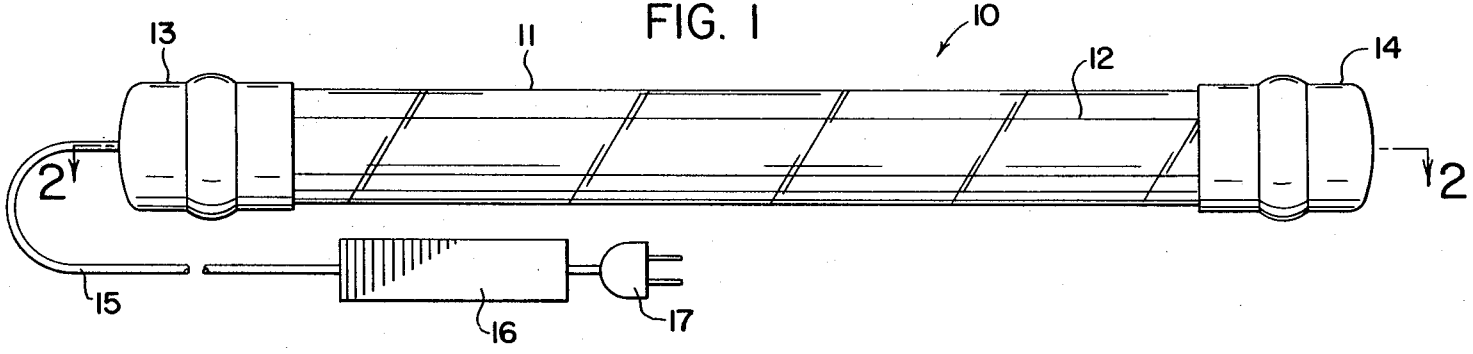
FIG. 1
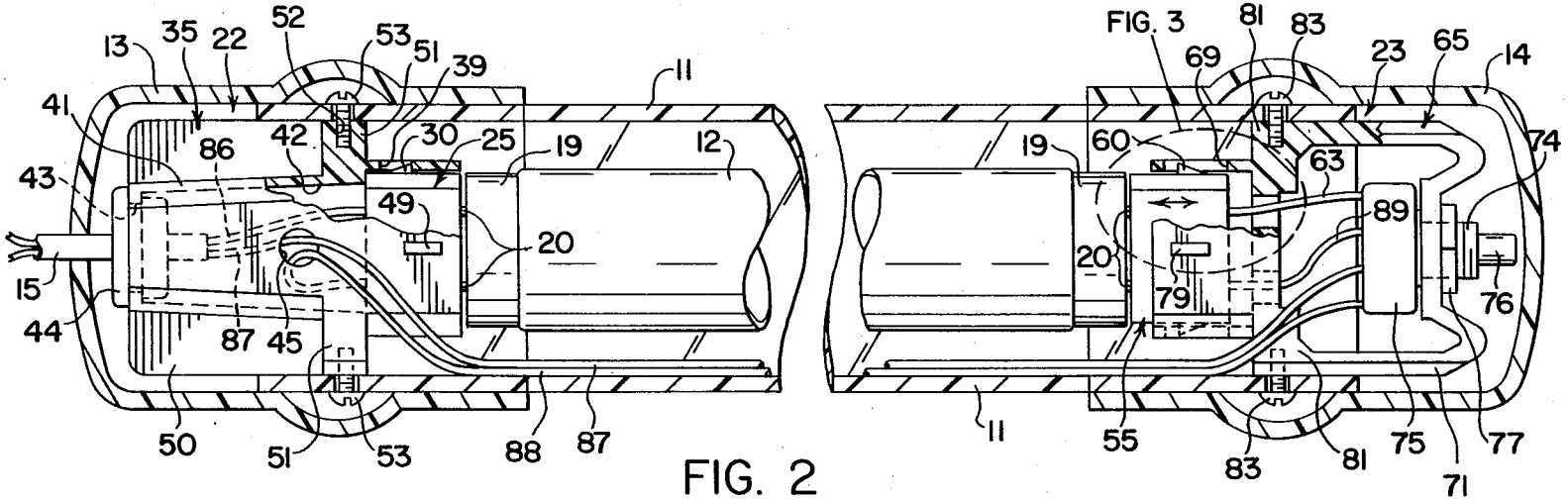
FIG. 2
FIG. 3

PORTABLE FLUORESCENT LIGHT UNIT

BACKGROUND OF THE INVENTION

1. Field of the Invention

This invention relates to portable light units, such as safety inspection lights or "trouble" lights, and especially to the type of portable light unit that utilizes a fluorescent lamp rather than an incandescent bulb. More particularly, the invention relates to an improvement in portable fluorescent light units to facilitate the mounting of the lamp within the unit.

2. Description of the Prior Art

Portable fluorescent light units have many advantages compared with other types of "trouble" lights. Such portable fluorescent light units are often used to particular advantage in garages where automobile service is performed, as well as in other unlighted areas, such as attics, that are used infrequently. Prior units of this type generally utilize a tubular transparent plastic housing of fairly sturdy construction in which a fluorescent lamp, such as a 15-watt, 17-inch lamp is mounted along with the necessary sockets and a switch associated with the electrical circuitry. A ballast is provided on the power cord, and the cord is usually of sufficient length to enable the light to be carried around a relatively large area.

Typical prior art constructions of these light units are shown in U.S. Pat. No. 3,136,489 issued to Oharenco, U.S. Pat. No. 3,140,045 issued to Oharenco, and U.S. Pat. No. 3,242,331 issued to Behringer.

One difficulty encountered in the assembly of this type of light unit concerns the attachment of the fluorescent lamp sockets to the transparent tubular plastic housing. The lamp is usually held within the housing by a pair of sockets, one socket attached to each end of the lamp, with the sockets being mounted on a support bracket which is attached to the housing. The lamp has pins at each end which are mounted in and engage the sockets, the sockets having internal means for making a point contact with the pins to provide an electrical connection. In the assembly of the light unit it is necessary to attach the sockets to the brackets and pull the wires which extend from the sockets through openings in the brackets. The wires from each of the sockets must then be spliced together and spliced to the wires extending from the cord. These multiple splices add to the cost of construction of the lamps and present potential safety hazards since each splice must be made cleanly, and carefully, and must be safely taped or covered with a suitable splice closure or "wire nut". In addition, it is preferable to enclose any splice within an insulating area to prevent the problem of inadvertent current flow or shocks. The splicing procedure requires additional time in the assembly of the lamp and must be done carefully to avoid any problems of shock or inadvertent current flow resulting from the splice connection.

Another difficulty encountered in the construction and assembly of these light units is in providing a means for holding the fluorescent lamp snugly between the sockets and at the same time accommodating thermal expansion and contraction of the housing to which the socket supports are mounted. This thermal expansion is often the result of the heat generated by the lamp and by environmental temperature variations to which the light unit is subjected. One solution to the problem of thermal expansion is shown in U.S. Pat. No. 4,092,706, issued to the present inventor, in which each of the sockets is mounted on a special socket support which is capable of bending to accommodate thermal expansion. While this design has been shown to be completely suitable for the accommodation of thermal expansion, the socket supports are generally formed of a sheet metal material and therefore do not provide additional insulating capabilities.

Further difficulties result from the contact made by the sockets. These sockets generally provide only a small area of electrical connection between the contact with the socket and the pins extending from the fluorescent lamp. These sockets are designed primarily for stationary applications, such as mounted fluorescent fixtures, and do not provide a reliable electrical connection when used in a portable fluorescent light unit. Furthermore, the point contact for the electrical connection also serves as a mechanical means for securing the fluorescent lamp to the socket. While this securing means may be suitable for stationary applications, it is inadequate in a portable light unit which is subject to rough and sometimes abusive treatment, particularly where the point contact occurs midway along the length of the pin. This holding arrangement may result in bending of the pin or possible breakage of the hermetic seal between the pin and fluorescent lamp when subjected to mechanical shock or vibration.

SUMMARY OF THE INVENTION

The construction of the present invention resolves the difficulties indicated above and affords other features and advantages heretofore not obtainable.

It is among the objects of the present invention to provide a portable electric light unit of the type described above which is more easily assembled than prior units. Another object is to provide a portable fluorescent light unit in which the wire providing the connection to the lamp socket can be inserted in a direction toward the lamp to simplify the wiring and reduce the number of splices necessary in the assembly of the lamp. Still another object is to provide a portable fluorescent light unit having a unique construction which accommodates thermal expansion and contraction of the lamp that may occur due to heat generated by the lamp and due to environmental temperature changes, in which all movement of the supporting portions for the lamp occurs in a direction parallel to the axis of the fluorescent lamp without utilizing any bending of portions which may be subject to fatigue over an extended period of time. Yet another object is to provide a portable fluorescent light unit in which the support for the fluorescent lamp is completely formed of an insulating material except for the socket portions which contact the lamp and provide the electrical connection between the lamp and the energizing circuitry. Still another object is to provide a portable fluorescent light unit in which the insulated lamp supports also contain an insulated chamber which may be used to enclose any splice and to eliminate the potential problems of electrical shock which may occur from the inadvertent contact of a portion of the splice with any conductive portions of the lamp unit. Another object is to provide a portable fluorescent light unit which has no splice connections within the unit. Another object is to provide a light unit having an improved electrical connection with the lamp which avoids the point contact of the prior art sockets. Another object is to provide a portable fluorescent light unit with an improved mechanical mounting arrangement between the lamp and the lamp socket assembly.

These and other objects and advantages are achieved by the portable fluorescent light unit of the present invention. The portable fluorescent light unit comprises an elongated transparent tubular housing and a fluorescent lamp positioned within the housing. The lamp has a pair of pins extending from each end. Electrical circuit means are provided for energizing the lamp, and four electrical connectors are provided which are adapted to be connected to the pins for connecting the lamp to the circuit means.

In accordance with one aspect of the present invention, a pair of electrically insulating lamp supports are provided at each end of the lamp within the housing. Each support comprises an inner socket element and an outer supporting element. The inner socket element fits against one end of the lamp and has a pair of apertures extending therethrough into which the pins extend and in which the connectors are mounted and connect with the pins. The outer supporting element is attached to the housing and fits snugly within the housing. The outer supporting element has a central opening into which the inner socket element is inserted in one end and supported thereby.

In accordance with another aspect of the invention, one of the lamp supports includes means for accommodating thermal expansion of the housing. The means comprises the inner socket element being slidably mounted within the opening in the outer supporting element and movable in a direction parallel to the axis of the fluorescent light.

In accordance with still another aspect of the invention, the inner socket element has a pair of projecting tabs along its sides. The outer supporting element has corresponding slides extending along the sides of the opening and adapted to receive the tabs. The inner socket element is thereby held in place when the socket element is inserted into the opening in the outer supporting element. In addition, the slots on one of the supporting elements may be elongated to permit the inner socket element mounted within the opening in the supporting element to be slidably movable within the opening in a direction parallel to the axis of the fluorescent lamp to accommodate thermal expansion of the housing.

In accordance with yet another aspect of the invention, one of the lamp supports may have a hollow portion at one end creating an insulating central chamber which may contain a splice or other sensitive electronic portion of the circuit means.

In accordance with another aspect of the invention, the four electrical connectors have cylindrical portions adapted to fit circumferentially around the pins, and may also extend axially a substantial distance along the length of the pins.

BRIEF DESCRIPTION OF THE DRAWINGS

FIG. 1 is a side elevational view illustrating a portable fluorescent light constructed in accordance with the present invention.

FIG. 2 is a side sectional view on an enlarged scale taken on line 2—2 of FIG. 1.

DESCRIPTION OF THE PREFERRED EMBODIMENT

Figure 3:
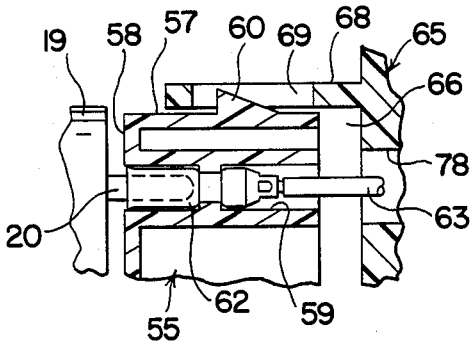
FIG. 3 is a detailed sectional view of a portion of FIG. 2 to a larger scale.

Referring more particularly to the drawings, and initially to FIG. 1, there is shown a portable fluorescent light unit 10 embodying the present invention and comprising a transparent tubular housing 11 containing a fluorescent lamp 12 which may be, for example, of 17-inch length located within the tubular housing 11. A pair of plastic covers 13 and 14 are placed over each end of the housing 11. A conventional power cord 15 extends from one end of the unit through an opening in the plastic cover 13, and a conventional ballast unit 16 is located along the power cord 15 between the light unit and a conventional plug 17.

As shown in FIG. 2, the fluorescent lamp 12 has cylindrical metal bases 19 at each end. The bases 19 each have a pair of pins 20 which extend in a direction parallel to the axis of the fluorescent lamp 12, in accordance with conventional design of fluorescent lamps. The pins 20 are used to provide an electrical connection between the lamp 12 and the energizing electrical circuit means and to provide a means by which the lamp is mounted in a conventional fluorescent lamp socket.

In accordance with the present invention, a pair of lamp supports 22 and 23 are provided for mounting the lamp 12 within the housing 11 and for supporting an electrical connection with the lamp through the outwardly extending pins 20. The supports 22 and 23 are both of very similar construction but are of different form and will be described separately. Each lamp support comprises an inner socket element and an outer supporting element.

Figure 4:
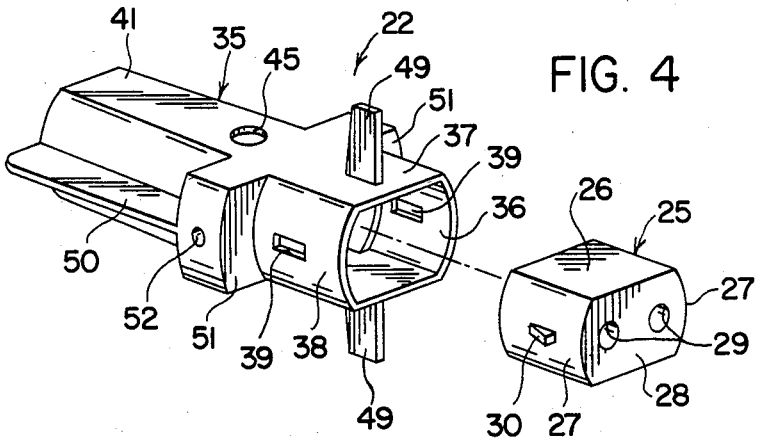
FIG. 4 is a perspective view of one of the lamp supports of the portable fluorescent light unit of FIGS. 1 and 2 embodying the construction of the invention, with the inner socket element removed from the outer supporting element.

The lamp support 22 includes an inner socket element 25. As shown in FIG. 4, the socket element 25 is formed of a molded plastic material and is generally oblong, having two smooth sides 26 and two curved sides 27. The element 25 also has a flat forward end surface 28 adapted to fit snugly against the lamp base 19. A pair of apertures 29 extend through the socket element 25 from the flat end surface 28, the spacing between the apertures 29 conforming to the spacing between the pins 20 which extend from the lamp base 19. The socket element 25 also has a pair of tabs 30, one extending from each of the curved sides 27. The tabs 30 are preferably tapered in design, so that each tab extends the maximum distance from the side 27 at the end of the tab closest to the flat end surface 28 of the socket element, and the tab tapers inwardly toward the surface of the curved side 27 as the tab extends in a direction away from the flat end surface 28.

The lamp support 22 also includes an outer supporting element 35. The supporting element 35 is also formed of a molded plastic material and has a central opening 36 extending inwardly from its forward end. The opening 36 is generally oblong in shape and conforms to the exterior dimensions of the inner socket 25 with two generally smooth side walls 37 which conform to the smooth sides 26 of the element 25 and curved side walls 38 which conform to the curved sides 27 of the socket element 25. The supporting element 35 has a pair of elongated slots 39 which extend through the curved side walls 38. The slots 39 are adapted to receive the tabs 30 when the socket element 25 is inserted into the central opening 36. Since the tabs 30 are tapered, the socket elements 25 fit easily within the central opening 36, the tabs camming the curved walls 38 outwardly slightly to accommodate the projecting tabs 30. When the socket element 25 is fully inserted within the opening 36, the tabs 30 project outwardly through the slots 39, and the curved sidewalls 38 snap tightly back in place against the curved sides 27 of the socket element. The tapered tabs 30 are then locked within the slots 39, securely holding the inner socket element 25 within the opening 36.

The outer supporting element 35 also has a generally tubular portion 41 which extends toward the rearward end of the supporting element opposite the central opening 36. The tubular portion 41 is hollow to provide an insulated chamber 42 which may be used for splices in the electrical wiring of the light unit (FIG. 2). An opening 43 is provided in the rearward end of the tubular portion 41 into which a conventional plastic grommet 44 may be mounted. The grommet 44 secures and protects the power cord 15 in the conventional manner, and may include appropriate strain relief means. Apertures are provided between the chamber 42 formed in the hollow tubular projection and the central opening 36. Preferably, two apertures are formed which are coaxial with the apertures 29 in the socket element 25 to permit wires extending from the chamber 42 to be easily inserted into the apertures 29. A hole 45 is provided along the side of the tubular portion 41 to provide access for wiring to extend into the chamber 42.

To position the supporting element 35 within the tubular housing 11, the supporting element has a pair of outwardly projecting ribs 49 which extend from the smooth side walls 37, and a pair of ribs 50 which extend radially outwardly from the tubular portion 41. For mounting the supporting element 35 within the housing 11, the supporting element has laterally extending mounting portions 51 which extend from each side of the supporting element between the curved side walls 38. The mounting portions 51 are each provided with a hole 52 and the projecting ribs 50 which are used to mount the supporting element 35 to the ends of the tubular housing 11 by means of screws 53 or other suitable fasteners (FIG. 2).

Figure 5:
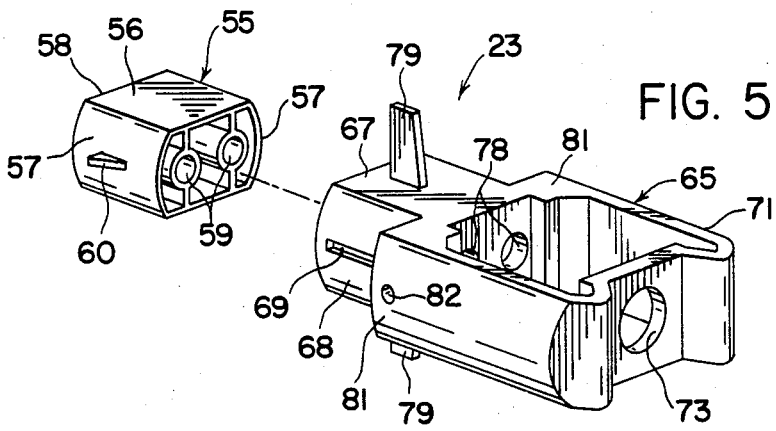
FIG. 5 is a perspective view similar to FIG. 4 illustrating the other lamp support of the portable fluorescent light unit of FIGS. 1 and 2 which also embodies the present invention, with the inner socket element also removed from the outer supporting element.

As shown in FIG. 5, the other lamp support 23 includes an inner socket element 55 which is essentially identical to the socket element 25 with two smooth sides 56 and two curved sides 57. The socket element 55 also has a flat forward end surface 58 adapted to fit snugly against the other lamp base 19 with a pair of apertures 59 extending through the socket element for receiving the pins 20 which extend from the lamp base. The inner socket element 55 also has a pair of tapered tabs 60 extending from each of the curved sides 57. As shown in FIG. 3, a female electrical connector 62 is mounted within each of the apertures 59 at the end of a wire 63.

Each of the connectors 62 is preferably a generally cylindrical-shaped or tubular element which fits securely on one of the lamp pins 20 to provide a secure electrical connection with and mechanical mount for the lamp 12. The connector 62 fits snugly around the pin 20, providing support circumferentially around the pin, and the cup-shaped connector extends a substantial distance axially along the length of the pin to support the pin and prevent torques from being applied to the pin which might bend the pin or break the seal between the pin and the lamp. The resulting electrical connection for the lamp and mechanical mounting arrangement for the lamp are thus more secure and more reliable under rugged conditions encountered by portable light units, and represent an improvement over fluorescent light sockets which rely on point contacts.

The lamp support 23 also includes an outer supporting element 65 (FIG. 5). The outer supporting element 65 has a central opening 66 (FIG. 3) extending axially inwardly from its forward end similar to the central opening 36 in the other supporting element 35. The opening 66 is generally oblong in shape and conforms to the exterior dimensions of the inner socket element 55 with two smooth upper and lower side walls 67 and two curved side walls 68. A pair of elongated slots 69 extend through each of the curved walls 68. The slots 69 are longer than the slots 39 formed in the other supporting element 35 in order to permit movement of the tabs 60 within the slots 69 and thus permit movement of the inner socket element 55 within the opening 66 in a direction generally parallel to the axis of the lamp 12. The insertion of the inner socket element 55 into the opening 66 is facilitated by the tapered construction of the tabs 60 which extend from the sides of the socket element 55. As the socket element 55 is inserted into the opening 66, the tab 60 cams the curved walls 68 of the supporting element 65 outwardly slightly to permit the extending tabs 60 to fit within the opening. When the socket element 55 has been inserted sufficiently within the opening 66 so that the tabs 60 project through the slot 69, the curved walls 68 snap tightly against the curved sides 57 of the socket element, preventing easy removal of the socket element 55. However, since the slots 69 are elongated, the tab 60 is free to move within the slot and thus the inner socket element 55 can move axially within the central opening 66 to aocommodate thermal expansion of the tubular housing 11 due to heat generated by the lamp 12 and due to operation under varying environmental temperatures.

The outer supporting element 65 also has a rearwardly extending generally U-shaped portion 71. At the rearward end of the portion 71 is a larger opening 73 adapted to receive the threaded mounting shaft 74 (FIG. 2) of a standard push button type switch 75 having a projecting control push button 76. The switch is secured by a nut 77 mounted on the shaft 74 in a conventional manner. The rearwardly extending end of the U-shaped portion 71 has shoulders on each side of the switch to protect the switch push button 76 and to prevent the resilient plastic end cover 14 from sliding onto the transparent housing 11 and preventing full operation of the switch 75. A pair of apertures 78 (FIG. 5) extend through the supporting element 65 from the U-shaped portion 71 to the central opening 66. The apertures 78 are coaxial with the apertures 59 in the socket element 55 to facilitate the insertion of wires, such as the wire 63 (FIG. 3), into the aperture 59. The sides of the U-shaped portion 71 are open to permit wires from the switch 73 and from the apertures 78 to extend outwardly and to permit easy installation of the switch 75.

To position the supporting element 65 in the housing 11, the outer supporting element has a pair of positioning ribs 79 (FIG. 5) which extend laterally from the smooth side wall 67 of the supporting element to position the supporting element within the tubular housing. For mounting the supporting element 65 in the housing 11, the supporting element has a pair of mounting portions 81 (FIG. 5) which extend radially outwardly from the curved side walls 68 at the forward end of the U-shaped portion 71. Each outwardly extending mounting portion 81 has a hole 82 adapted to receive a screw 83 or other suitable fastener by which the outer supporting element 65 is mounted to the end of the tubular housing 11 (FIG. 2).

In the assembly of the portable fluorescent light unit 10, the fluorescent lamp 12 is positioned within the tubular housing 11. The end of the power cord 15 is then inserted through the opening 43 in the rear tubular portion 41 of the outer supporting element 35 with the plastic grommet 44 positioned within the opening. A pair of wires 86 and 87 extend from the power cord. One of the wires 86 is inserted from the chamber 42 in the tubular portion 41 through the apertures provided in the supporting element 35 and into the central opening 36 of the supporting element 35. The other wire 87 is pulled from the chamber 42 through the hole 45 in the side of the supporting element 35, is extended through the housing 11 and is connected to the switch 75. Another wire 88 from the switch 75 is extended through the housing 11, is inserted through the hole 45 in the supporting element 35 and inserted into the central opening 36. The switch 75 is then mounted by means of the nut 77 in the opening 73 on the end of the outer supporting element 65. Another pair of wires 63 and 89 which extend from the switch 75 are inserted through the apertures 78 into the central opening 66 in the outer supporting element 65.

Female electrical connectors, such as the connectors 62 (FIG. 3), are then placed on the ends of each of the wires 63, 86, 88 and 89 and the connectors are inserted through the apertures 29 and 59 of the inner socket elements 25 and 55. After the connectors 62 have been placed within the apertures 29 and 59, each of the inner socket elements 25 and 55 is placed on a base 19 at each end of the fluorescent lamp 12, and the connectors 62 are placed over the pins 20 which extend from the lamp, so that the lamp is securely connected to the inner socket elements. The socket elements 25 and 55 are then inserted into the central openings 36 and 66 of the outer supporting elements 35 and 65. The tabs 30 and 60 on the socket elements 25 and 55 outwardly cam the side walls 38 and 68 of the supporting elements 35 and 65, until the tabs snap into place. The tabs 30 and 60 then extend through the slots 39 and 69. As the outer supporting elements 35 and 65 are moved into place at each end of the lamp 12, they are moved within the tubular housing 11. The supporting elements 35 and 65 are then positioned so that the screws 53 and 83 may be inserted through the tubular housing 11 and into the mounting portions 51 and 81. As the screws 53 and 83 are secured in place, the lamp supports 22 and 23 are firmly secured within the housing 11 providing a stable support for the fluorescent lamp 12. The inner socket element 55 is free to move axially within the opening 66 in the outer support element 65 to accommodate thermal expansion of the tubular housing 11 due to heat generated by the lamp 12 and due to operation under varying environmental temperatures. Finally, the plastic covers 13 and 14 are placed over each end of the tubular housing 11 to cover the screws 53 and 83 and to seal the ends of the housing to prevent moisture from entering the enclosure.

Thus the present invention provides a portable fluorescent light unit which may be easily assembled because the electrical connectors 62 may be placed on the end of the wires 63, 86, 88 and 89 and the wires mounted within the inner socket elements 25 and 55 and connected to the lamp 12 before the remaining portions of the light unit are assembled. The socket elements 25 and 55 are then easily snapped into the openings 36 and 66 in the outer supporting elements 35 and 65. The tapered tabs 30 and 60 provide a means for easily inserting the socket elements 25 and 55 within the supporting elements 35 and 65 while providing a means for securely holding the socket elements in place without the necessity of screws, bolts, rivets, or other means which require additional time in the assembly of the light units. In addition, since the electrical connectors 62 are placed on the wires and the wires may be inserted through the rearward portion of the socket elements, it is possible to assemble the fluorescent light unit without making any splices in the wires, which splices require time and expense in assembly of the unit and may result in faulty electrical connections.

If, however, splices are used, as is common in the assembly of such light units, all of the splices may be contained within the chamber 42 in the portion 41 of the outer supporting element 35, and since the element 35 which completely surrounds the chamber is completely formed of plastic insulating material, an insulated splice chamber is formed which reduces the possibility of inadvertent shock due to the contact of the splices with a conducting medium. Using conventional methods of assembly, such a splice would occur if the light unit is first assembled and wired, and thereafter the power cord 15 is connected to the light unit. Splices would then be made between the end of the power cord 15 and the ends of the wires 86 and 87, and these splices would be contained in the chamber 42.

While the invention has been shown and described with respect to a specific embodiment thereof, it will be apparent to those skilled in the art that other variations and modifications of the specific form herein shown and described may be used without departing from the spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. An improved fluorescent light of the type having an elongated tubular housing, a fluorescent lamp positioned within said housing, said lamp having a pair of pins extending from each end, electrical circuit means for energizing said lamp, and four electrical connectors adapted to be connected to said pins for connecting said lamp to said circuit means, wherein the improvement comprises:

a pair of electrically insulating lamp supports at each end of said lamp within said housing, each of said supports comprising an inner socket element fitting against an end of said lamp, said socket element having a pair of apertures extending therethrough into which said pins extend and in which said connectors are mounted and connected to said pins, and an outer supporting element attached to said housing and fitting snugly within said housing, said supporting element having a central opening into which said inner socket element is inserted at one end and supported thereby.

2. The improved portable fluorescent light unit of claim 1, wherein one of said lamp supports includes means for accommodating thermal expansion of said housing, said means comprising said inner socket element being slidably mounted within said opening in said outer supporting element and movable in a direction parallel to the axis of said fluorescent lamp.

3. The improved portable fluorescent light unit of claim 1, wherein said inner socket element has a pair of projecting tabs along its sides, and said outer supporting element has corresponding slots extending along the sides of said central opening and adapted to receive said tabs, whereby said inner socket element is held in place when said socket element is inserted into said central opening in said outer supporting element.

4. The improved portable fluorescent light unit of claim 3, wherein said slots on one of said supporting elements are elongated to permit said inner socket element mounted within said central opening in said supporting element to be slidably movable within said opening in a direction parallel to the axis of said fluorescent lamp to accommodate thermal expansion of said housing.

5. The improved portable fluorescent light unit of claim 3, wherein said tabs have tapered upper surfaces to permit said inner socket element to be inserted into said opening in said outer supporting element.

6. The improved portable fluorescent light unit of claim 1, wherein each of said outer supporting elements has radially extending ribs projecting therefrom for positioning said lamp support within said housing.

7. The improved portable fluorescent light unit of claim 1, wherein each of said socket elements and said supporting elements is formed of a single piece of molded plastic.

8. The improved portable fluorescent light unit of claim 1, wherein one of said supporting elements has a hollow portion at one end opposite said opening forming an insulated chamber for a portion of said circuit means containing splices.

9. A portable fluorescent light unit which comprises:
an elongated transparent tubular housing;
a fluorescent lamp positioned within said housing, said lamp having a pair of pins extending from each end;
electrical circuit means for energizing said lamp;
a pair of electrically insulated lamp supports at each end of said lamp within said housing, each support comprising
an inner socket element fitting against an end of said lamp, said socket element having a pair of apertures extending therethrough into which said pins extend, and
an outer supporting element attached to said housing and fitting snugly within said housing, said supporting element having a central opening into which said inner socket element is inserted at one end and supported thereby; and
four electrical connectors adapted to be connected to said pins for connecting said lamp to said circuit means, each of said connectors being mounted within one of said apertures and connected to said pins therein.

10. A portable fluorescent light unit as recited in claim 9, wherein one of said lamp supports includes means for accommodating thermal expansion of said housing, said means comprising said inner socket element being slidably mounted within said opening in said outer supporting element and movable in a direction parallel to the axis of said fluorescent lamp.

11. A portable fluorescent light unit as recited in claim 9, wherein each of said electrical connectors has cylindrical portions adapted to fit circumferentially around one of said pins.

12. A portable fluorescent light unit as recited in claim 11, wherein said electrical connectors extend axially a substantial distance along the length of said pins.

13. A portable fluorescent light unit as recited in claim 9, wherein one of said supporting elements has a hollow portion at one end forming an insulated chamber therein adapted to contain a portion of said electrical circuit means.

14. A portable fluorescent light unit as recited in claim 9, wherein said inner socket element has a pair of projecting tabs along its sides, and said outer supporting element has corresponding slots extending along the sides of said central opening and adapted to receive said tabs, whereby said inner socket element is held in place when said socket element is inserted into said opening in said outer supporting element.

15. A portable fluorescent light unit as recited in claim 14, wherein said slots on one of said supporting elements are elongated to permit said inner socket element mounted within said opening in said supporting element to be slidably movable within said opening in a direction parallel to the axis of said fluorescent lamp to accommodate thermal expansion of said housing.

16. A portable fluorescent light unit as recited in claim 14, wherein said tabs have tapered upper surfaces to permit said inner socket element to be inserted in said opening in said outer supporting element and securely held therein.

17. A portable fluorescent light unit as recited in claim 9, wherein each of said outer supporting elements has radially extending ribs projecting therefrom for positioning said lamp support within said housing.

18. A portable fluorescent light unit as recited in claim 9, wherein each of said socket elements and said supporting elements is formed of a single piece of molded plastic.

19. A portable fluorescent light unit which comprises:
an elongated transparent tubular housing;
a fluorescent lamp positioned within said housing, said lamp having a pair of pins extending from each end;
electrical circuit means for energizing said lamp;
a pair of electrically insulated lamp supports mounted within said housing, each support fitting against an end of said lamp and having a pair of apertures extending therethrough into which said pins extend; and
four electrical connectors adapted to be connected to said pins for connecting said lamp to said circuit means, each of said connectors being mounted within one of said apertures and connected to said pins therein, each of said connectors having cylindrical portions adapted to fit circumferentially around one of said pins.

20. A portable fluorescent light unit as recited in claim 19, wherein said electrical connectors extend axially a substantial distance along the length of said pins.

21. A portable fluorescent light unit as recited in claim 19, wherein each of said lamp supports comprises:

an inner socket element fitting against an end of said lamp, said socket element having said pair of apertures extending therethrough into which said pins extend; and an outer supporting element attached to said housing and fitting snugly within said housing, said supporting element having a central opening into which said inner socket element is inserted at one end and supported thereby.

22. A portable fluorescent light unit as recited in claim 19, wherein one of said lamp supports has a hollow portion at one end forming an insulated chamber therein adapted to contain a portion of said electrical circuit means.

23. A portable fluorescent light unit as recited in claim 19, wherein each of said lamp supports has radially extending ribs projecting therefrom for positioning said lamp support within said housing.

24. A portable fluorescent light unit as recited in claim 19, wherein each of said lamp supports comprises an element formed of a single piece of molded plastic.

25. A portable fluorescent light unit which comprises:

an elongated transparent tubular housing;

a fluorescent lamp positioned within said housing, said lamp having a pair of pins extending from each end;

electrical circuit means for energizing said lamp; and a pair of electrically insulated lamp supports mounted within said housing, each support fitting against an end of said lamp and having electrical connectors adapted to be connected to said pins for connecting said lamp to said circuit means, one of said supports having a hollow portion at one end forming an insulating chamber for a portion of said circuit means containing splices.

26. A portable fluorescent light unit as recited in claim 25, wherein each of said lamp supports comprises:

an inner socket element fitting against an end of said lamp, said socket element having a pair of apertures extending therethrough into which said pins extend and in which said connectors are mounted and connected to said pins; and an outer supporting element attached to said housing and fitting snugly within said housing, said supporting elements having a central opening into which said inner socket element is inserted at one end and supported thereby, one of said supporting elements having said hollow portion at the end opposite said opening forming said insulating chamber.

27. A portable fluorescent light unit as recited in claim 25, wherein each of said electrical connectors has cylindrical portions adapted to fit circumferentially around one of said pins.

28. A portable fluorescent light unit as recited in claim 27, wherein said electrical connectors extend axially a substantial distance along the length of said pins.

29. A portable fluorescent light unit which comprises:

an elongated transparent tubular housing subject to elongation due to thermal expansion;

a fluorescent lamp positioned within said housing, said lamp having a pair of pins extending from each end;

electrical circuit means for energizing said lamp;

a pair of electrically insulating lamp supports at each end of said lamp within said housing, each support comprising an inner socket element fitting against an end of said lamp, said socket element having a pair of apertures extending therethrough into which said pins extend, said inner socket element also having a pair of projecting tabs along its sides, each of said tabs having a tapered upper surface, and an outer supporting element attached to said housing and fitting snugly within said housing, said supporting element having a central opening into which said inner socket element is inserted at one end, said supporting element also having slots corresponding to said tabs extending along the sides of said opening and adapted to receive said tabs, whereby said inner socket element is held in place when said socket element is inserted into said opening, said slots on one of said supporting elements being elongated to permit said inner socket element mounted within said opening in said one supporting element to be slidably movable within said opening in a direction parallel to the axis of said fluorescent lamp to accommodate thermal expansion of said housing, one of said supporting elements having a hollow portion at one end opposite said opening having an insulated chamber for a portion of said circuit means; and four electrical connectors adapted to be connected to said pins for connecting said lamp to said circuit means, each of said connectors mounted in one of said apertures and connected to said pins therein, each of said connectors having cylindrical portions adapted to fit circumferentially around one of said pins and extending axially a substantial distance along the length of said one of said pins.

* * * * *